US005181361A

United States Patent [19]

Hannah et al.

[11] Patent Number: 5,181,361

[45] Date of Patent: Jan. 26, 1993

[54] MULTI-LAYER SHINGLE

[75] Inventors: Marcia G. Hannah, Wayne; George W. Mehrer, Jenkintown; Michael J. Noone, Wayne; Kermit E. Stahl, North Wales; Joseph Quaranta, Yardley, all of Pa.

[73] Assignee: CertainTeed Corporation, Valley Forge, Pa.

[21] Appl. No.: 515,601

[22] Filed: Apr. 27, 1990

Related U.S. Application Data

[63] Continuation-in-part of Ser. No. 110,801, Oct. 20, 1987, Pat. No. Des. 314,628, which is a continuation-in-part of Ser. No. 174,023, Mar. 28, 1988.

[51] Int. Cl.[5] ..... E04D 1/00

[52] U.S. Cl. ..... 52/535; 52/553; 52/554

[58] Field of Search ..... 52/535, 553, 554, 533, 52/534, 408, 316

[56] References Cited

U.S. PATENT DOCUMENTS

| | | | |
|---|---|---|---|
| 2,045,423 | 6/1936 | Topping . | |
| 3,377,762 | 4/1968 | Chalmers et al. . | |
| 3,468,092 | 9/1969 | Chalmers et al. . | |
| 3,547,280 | 12/1970 | Giegerich . | |
| 3,562,070 | 2/1971 | Adams et al. . | |
| 3,613,328 | 10/1971 | Morgan et al. . | |
| 3,624,975 | 12/1971 | Morgan et al. . | |
| 3,886,021 | 5/1975 | Breckenfelder . | |
| 3,921,358 | 11/1975 | Bettoli . | |
| 3,998,685 | 12/1976 | Czyzewski . | |
| 4,050,209 | 9/1977 | Barker et al. | 52/553 X |
| 4,198,257 | 4/1980 | Pfaff . | |
| 4,233,100 | 11/1980 | Cunningham et al. . | |
| 4,274,243 | 6/1981 | Corbin et al. . | |
| 4,295,445 | 10/1981 | Kopenhaver . | |
| 4,352,837 | 10/1981 | Kopenhaver . | |
| 4,499,701 | 2/1985 | Bockwinkel et al. | 52/553 X |
| 4,637,191 | 1/1987 | Smith | 52/523 X |
| 4,717,614 | 1/1988 | Bondoc et al. | 52/553 X |
| 4,729,814 | 3/1988 | Jennus et al. . | |
| 4,848,057 | 7/1989 | MacDonald et al. | 52/554 X |
| 4,856,251 | 8/1989 | Buck | 52/553 |
| 4,869,942 | 9/1989 | Jennus et al. . | |

FOREIGN PATENT DOCUMENTS

| | | | |
|---|---|---|---|
| 963626 | 3/1975 | Canada | 52/553 |
| 2431665 | 1/1976 | Fed. Rep. of Germany | 52/535 |

OTHER PUBLICATIONS 239-86.
131-87.
132-87.
133-87.

*Primary Examiner*—Richard E. Chilcot, Jr.
*Assistant Examiner*—Lan Mai
*Attorney, Agent, or Firm*—Paul & Paul

[57] ABSTRACT

A multi-layer shingle is provided, comprising three shingle layers; specifically, a base layer, a secondary layer and a top layer. The base layer and the secondary layer each have butt portions and tab portions. The secondary layer has tab portions that are preferably somewhat shorter than the tab portions of the base layer, showing portions of the tab portions of the base layer beneath the tab portioins of the secondary layer. The top, or third layer is comprised of individual strips that are preferably narrower than the tab portions of the secondary layer, and which preferably extend up into the butt portion of the secondary layer, in overlying relationship therewith. The base layer and secondary layer are secured together by preferably horizontal adhesive stripes. Adhesive also secures the top or third layer strips to the secondary layer, preferably by means of vertical adhesive stripes. Different granule applications are provided for desired aesthetic effects. Optionally, a shadow line may be provided on the upper surface of the secondary layer at the juncture of the butt and tab portions thereof. Different tab portions of the secondary layer may have different vertical heights, for random effect. Each of the base and secondary layers is approximately twice as wide as high, such that two such layers may be cut from a substantially square piece of shingle material. The final shingle may be palletized at two generally coplanar shingles per layer, with alternate layers disposed at 90 degrees relative to each other.

24 Claims, 2 Drawing Sheets

MULTI-LAYER SHINGLE

CROSS REFERENCE TO RELATED APPLICATIONS

This is a continuation-in-part of design application Ser. No. 110,801 filed Oct. 21, 1987, now U.S. Pat. No. D314,628 and of U.S. design application Ser. No. 174,023 filed Mar. 28, 1988.

BACKGROUND OF THE INVENTION

The present invention is directed to a multi-layer shingle, preferably one constructed of asphaltic roofing material, and most particularly one having an asphaltic material provided over a base mat, which then has granules applied to surfaces thereof.

The art of shingle manufacture is highly developed, and improvements in shingle manufacturing have been subtle, often being devoted to the simulation of wood or other natural appearing shingles, having natural appearing textures.

In the course of shingle development, some approaches have been toward applying granules of various color configurations. Other developments have applied shadow bands to give the appearance of depth at various locations along the shingles. Still other techniques have involved irregular cuts in tab portions of the shingles, to give scalloped or random appearances. Some of the above improvements are set forth in U.S. Pat. No. 4,352,837, the complete disclosure of which is herein incorporated by reference.

The present invention is directed toward providing a multi-layer shingle, of three shingle layers, with spatial and arrangement configurations that are efficiently made possible to give a large number of optional variations in random appearance, while providing a high quality shingle.

Accordingly, it is a primary object of this invention to provide a novel multi-layer shingle.

It is a further object of this invention to provide a novel multi-layer shingle having unique variation possibilities in aesthetic presentation.

It is a further object of this invention to accomplish the above objects, wherein a top shingle layer may be provided over at least tab portions of shingles, with selective applicability.

It is yet another object of this invention to provide a novel multi-layer shingle that lends itself to readily palletized stacking.

It is a further object of this invention to provide a novel multi-layer shingle wherein the several layers are securely adhered together.

Other objects and advantages of the present invention will be readily apparent to those skilled in the art from a reading of the following brief description of the drawing figures, detailed description of the preferred embodiment and the appended claims.

SUMMARY OF INVENTION

A multi-layer shingle is provided having a base layer, a secondary layer and a top shingle layer, with the secondary layer having spaced-apart slots forming tab portions, and with the top layer covering at least a portion of tab portions of the secondary single layer.

BRIEF DESCRIPTIONS OF THE DRAWING FIGURES

DETAILED DESCRIPTION OF THE PREFERRED EMBODIMENT

Figure 1:
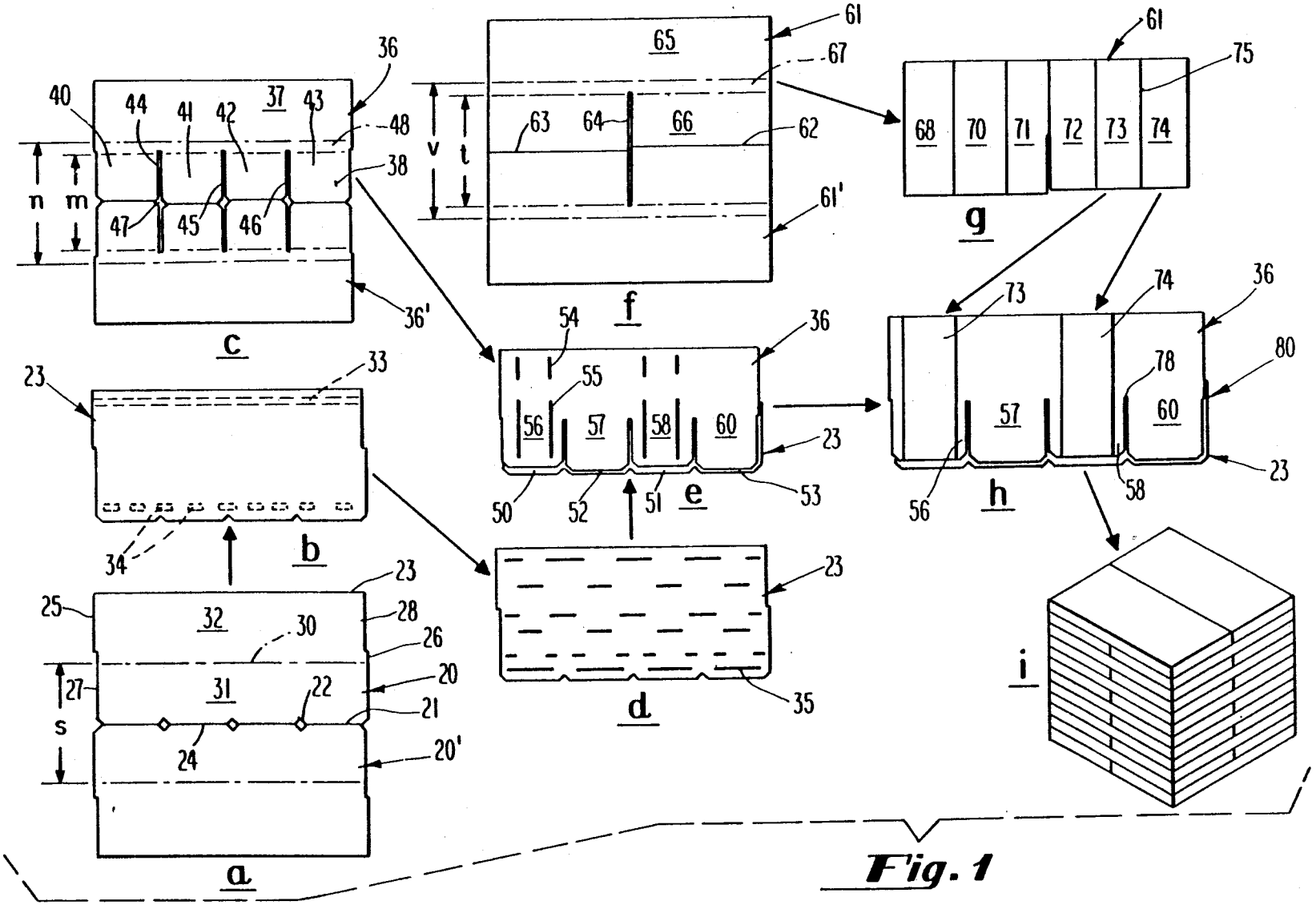
FIG. 1 is a schematic collective illustration of shingle components, wherein there are illustrated in sub-figures 1*a* through 1*i*, shingle components in various stages of manufacture and combination.

Referring now to the drawings in detail, reference is first made to FIG. 1, wherein FIG. 1*a* illustrates a pair of shingle bottom pieces 20 and 20', which are generally constructed together from a piece of shingle stock. Typically, the shingle stock is constructed in substantially endless fashion (not shown), in the form of a 36 inch wide web. This web may be cut in half along line 21, with appropriate notches 22, yielding two shingles each of a height that is half the dimension of the original 36 inch web. Each of the shingles 20 and 20' will preferably be identically constructed to have top and bottom edges 23, 24, and left and right sides having protruding and notched portions 25, 26 and 27, 28, respectively. An imaginary line 30 defines a zone or surface portion above the bottom edge 24 that will preferably be provided with granules of a selected coloration, such as a dark slag-type granule, because, as will hereinafter be understood, portions of the tab zone 31 below the butt zone 32 will be visible after the shingle is completely constructed. By the use of such dark or slag-type granules, the rich appearance of depth will be enhanced. Accordingly, the darker granules will preferably be provided in the zone "s" in the double shingle construction illustrated in FIG. 1*a*. The zone 32 can use granules the same as or different than zone 31, but will most efficiently use waste granules because such will not generally be visible after the shingle is completely constructed.

With reference now to FIG. 1*b*, it will be seen that the bottom shingle layer 20 has been separated from shingle layer 20', and has had a release tape of conventional type applied across the upper portion, on the underneath of the shingle layer 23, and is identified by the numeral 33. Also on the bottom surface of the shingle, a line of sealant 34, preferably in the form of a broken line is provided. The release tape 33 is provided to overlie the sealant 34 of another shingle, when adjacent shingles are disposed against one another, in stacked relation.

The shingle layer 23 is next shown in FIG. 1*d*, wherein a plurality of stripes 35 of adhesive is provided to securely adhere the shingle layer 23 to a secondary shingle layer 36, that is to be applied thereover. The application of the sealant stripes 35, when applied in the long dimension to the shingle layer 23, as illustrated, preferably with ample stripes at the upper and lower ends of the shingle layer 23, along with intermediate stripes arranged for example as shown, will prevent the secondary shingle layer 36 from being separated from the base shingle layer 23, by means of wind or the like when the shingles are installed on a roof.

With particular reference to FIG. 1*c*, a pair of secondary shingle layers 36, 36' is constructed generally similar to the manner in which the shingle layers 20, 20' are constructed, although of a preferably slightly smaller dimension, for reasons that will be understood hereinafter.

The shingle layer 36 likewise has a butt portion or zone 37 and a tab portion or zone 38, the latter of which is divided into four tab portions 40, 41, 42, 43, separated by slots 44, 45 and 46, defining separate tabs therebetween, wherein the tabs of the secondary layer have lower terminal edges defining shorter tab heights than the height of tab portions 31 of shingle base layer 20, as measured from the corresponding butt portions, leaving exposed lower portions 50-53 of tabs of said base layer 20.

It will be noted that tabs 40 and 42 are of a shorter height dimension than the tabs 41, 43, to facilitate a random appearance as will be seen hereinafter, with reference to FIG. 1*h*, in the completed shingle. Also, notches 47 are provided in the cut line that separates the shingle layers 36, 36', in the same manner as the notches 22 that separate the base shingle layers 20, 20'.

For aesthetic purposes, a preferably colored granule zone "m" is provided, in the tab surface portions of the shingle layers 36, 36'. Outside the zone "m", there is a shadow line zone "n", optionally provided at 48, which may, if desired receive darker granules, to provide a shadow line effect in the finished shingle (not shown in FIG. 1*h*).

The zone 37 of shingle layer 36 may use either colored granules, darker granules, or waste granules, as are desired.

With particular reference to FIG. 1*e*, it will be seen that the lower shingle layer 23 is disposed beneath, and has secondary shingle layer 36 disposed thereover, adhered thereto by the adhesive stripes 35 discussed above. It will also be seen that in this arrangement, thicker zones 50, 51 and thinner zones 52, 53 are provided beneath the tabs 40–43 of shingle layer 36, again for the random aesthetic effect achieved thereby.

It will also be apparent, with reference to FIG. 1*e*, that vertical adhesive stripes 54, 55 are provided in desired, selected butt and tab portions of the shingle layer 36. In this regard, it will be apparent that, in the four-tab illustration for the secondary shingle layer 36 of FIG. 1*e*, any one or more, or even all, if desired, of the zones 56, 57, 58 and 60 may have the adhesive stripes 54, 55 applied thereto, as may be desired. Moreover, it will be apparent that, while the illustration of FIG. 1*e* shows the shingle layers 23, 36, in the form of a two-ply four-tab shingle, such could be a three-tab shingle, a two-tab shingle, a five-tab shingle, etc., as may be desired, depending upon the desired appearance for the completed shingle of FIG. 1*h*. In application of the adhesive stripes, it is particularly important that the adhesive at 55 be provided as close to the bottom edge of the zone 56, 58, as possible, in order to assure adherence thereto of portions of a third shingle layer, as will hereinafter be described.

With reference now to FIG. 1*f*, it will be seen that a third two-line arrangement for shingle layers 61, 61' is provided, in generally the same manner as has been described above with respect to FIG. 1*a*, but wherein the separation line between the shingle layers 61 and 61' is provided in a plurality of staggered cuts 62, 63, intersected at 90 degrees by a slot line 64. The shingle layer 61 has a butt zone 65 and a tab zone 66. Generally, granules of desired coloration will be provided to the surface portions in the zone 66, with, optionally, other granules or waste granules, or even granules of the same coloration, provided in the zone 65. In this regard, with this shingle layer as with other shingle layers, it will be apparent that, because of the overlapping nature in which singles are normally applied on a roof, with shingles in one course covering a portion of shingles in another course, those shingle portions that have waste or other granules applied thereto in butt portions thereof, will not generally be visible in a completed roof. Also, optionally, a shadow line zone 67 may be provided between the zone defined by phantom line "t" having colored granules and the phantom line "v" that establishes the upper layer for the shadow line zone 67. In the zone 67, generally darker granules will be applied, if there is to be any variation in shingle coloration or shading at this point.

Thereafter, the shingle layer 61 is shown in FIG. 1*g*, in which it is divided into a plurality of strips each of narrower width than the width of the tab portion to which it is applied, preferably six in number as shown at 68, 70, 71, 72, 73 and 74, by means of appropriate slits such as 75.

It will be noted that the third layer shingle strips 72, 73 and 74 are shorter in height than those 68, 70 and 71, because of the placement of the cuts 62, 63 that form the lower edges of the shingle layer 61.

Strips 73, 74 are then applied over zones 56 and 58 of shingle layer 36, over the adhesive stripes 54, 55 thereof, to yield the triple layer shingle 80 shown in FIG. 1*h*. It will be apparent that the shorter strips 73, 74 correspond to the shorter tab portions for the layer 36, and that, if shingle strips were to be applied to tab zones 57 or 60 of secondary shingle layer 36, one would preferably use longer strip portions such as 68, 70 or 71, to correspond in height to the bottom edges of tab portions thereof.

It will thus be apparent that the completed shingle 80 shown in FIG. 1*h* can take on various configurations, in that the third layer strips may be in any combination of one, two, three, or more tab portions, and that while such may preferably extend throughout the complete height of whatever section of the shingle layer 36 to which such strips are applied, in the alternative, it is also possible that the strips 74 could extend a lesser height, but always preferably from the bottom edge of the tab portions of the shingle layer 36, to at least above the level of the slots 78.

With reference now to FIG. 1*i*, it will be seen that completed shingles may be stacked in palletized form, as shown, with two shingles in a given layer, with the next overlying layer of shingles being stacked thereon, being oriented at a right angle or approximately 90 degrees relative thereto, as shown, to yield a stable palletized configuration.

Figure 2:
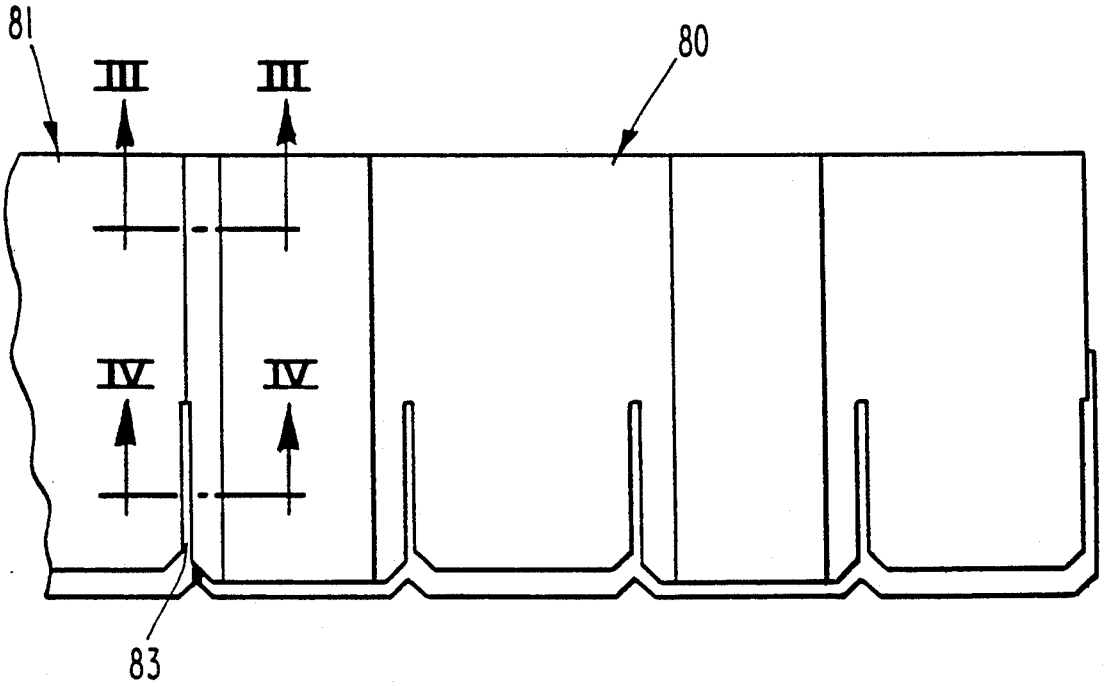
FIG. 2 is a top plan view of a shingle in accordance with this invention, in set-up adjacent relation to another shingle that is fragmentally illustrated, to show the relationship of adjacent shingles to each other.

With particular reference now to FIG. 2, there is illustrated a shingle 80, disposed against a next adjacent shingle 81 (fragmentally illustrated) to the left thereof.

Figure 3:
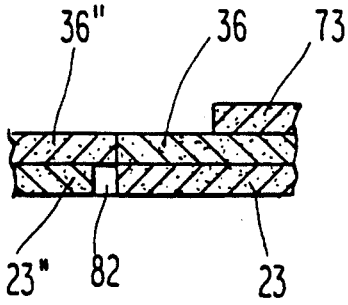
FIG. 3 is an enlarged fragmentary sectional view taken through the juncture of the two shingles illustrated in FIG. 2, generally along the line III—III of FIG. 2.

With particular reference to FIG. 3, it will be seen that shingle layer 36 is disposed in abutting relation to an adjacent secondary layer 36" to the left thereof, while the base shingle layers 23, 23" are disposed slightly spaced apart at 82. This enables ready alignment of the left and top edges of the shingles upon installation.

Figure 4:
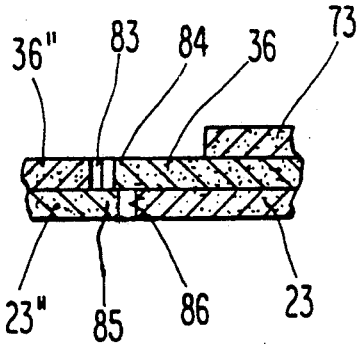
FIG. 4 is an enlarged fragmentary sectional view taken through the juncture of the two shingles illustrated in FIG. 2, generally along the line IV—IV of FIG. 2.

With reference to FIG. 4, it will be seen that in the tab zones of the shingles 80, 81 a space 83 is shown for illustrating the slot line formed between tab portions of adjacent shingles, and wherein the left-most edge 84 of the shingle layer 36, overlies an edge portion 85 of the shingle layer 23'', and that the shingle layer 23'' and the shingle layer 23 are likewise spaced apart at 86. This overlap at 84, 85 provides protection from the elements, such as rain, wind, etc., once a roof is installed, but yet permits proper alignment of base portions of the shingles.

It will therefore be apparent from the foregoing that various modifications may be made in details of construction, as well as in providing numerous different aesthetic combinations of shingle arrangements, for achieving a desired random appearance of natural shingles, by variations in placements of portions of top shingle layers, by variations in color, shadowing, and/or exposures, such as, but not limited to lengths of tabs, all within the spirit and scope of the invention as defined in the appended claims.

What is claimed is:

1. A multi-layer laminated shingle comprising:

(a) a base layer having a butt portion and a tab portion;

(b) a secondary layer having a butt portion and a tab portion and having said butt portion and tab portion substantially overlying said butt and tab portions respectively of said base layer, with a plurality of substantially spaced-apart slots in the tab portion defining spaced shingle tabs of predetermined widths; and (c) with at least one shingle strip portion comprising a top shingle layer applied and covering at least a portion of at least one tab of said secondary shingle layer;

said shingle layers each comprising a bituminous coated web between top and bottom surface portions having granules applied to top surface portions thereof; and means laminating said layers together with granules sandwiched between said laminated layers.

2. The shingle of claim 1, wherein each said top shingle layer strip is comprised of at least one shingle strip of narrower width than the width of the tab to which the shingle strip is applied.

3. The shingle of claim 2, wherein each said top shingle layer strip is comprised of at least one shingle strip corresponding in height to substantially the aggregate height of the butt portion and tab portion of said underlying secondary shingle layer.

4. The shingle of claim 1, wherein the tabs of the secondary layer have lower terminal edges defining shorter tab heights than the height of said tab portion of said base layer as measured from the corresponding butt portions, leaving exposed lower portions of tabs of said base layer.

5. The shingle of claim 1, wherein selected tabs of the secondary layer have lower terminal edges of different dimensions as measured from said butt portions, leaving differing heights of exposed lower portions of selected tab portions of said base layer therebeneath.

6. The shingle of claim 1, wherein the tabs of the secondary layer have lower terminal edges defining shorter tab heights than the height of said tab portion of said base layer as measured from the corresponding butt portions, leaving exposed lower portions of tabs of said base layer, wherein selected tabs of the secondary layer have lower terminal edges of different dimensions as measured from said butt portions, leaving differing heights of exposed lower portions of selected tab portions of said base layer therebeneath.

7. The shingle of claim 1, wherein a plurality of top shingle layer strips are provided, each covering at least a portion of at least one tab of said secondary shingle layer.

8. The shingle of claim 1, wherein each said top shingle layer strip is comprised of at least one shingle strip of narrower width than the width of the tab to which the shingle strip is applied; wherein a plurality of top shingle layer strips are provided, each covering at least a portion of at least one tab of said secondary shingle layer; wherein the tabs of the secondary layer have lower terminal edges defining shorter tab heights than the height of said tab portion of said base layer as measured from the corresponding butt portions, leaving exposed lower portions of tabs of said base layer, wherein selected tabs of the secondary layer have lower terminal edges of different dimensions as measured from said butt portions, leaving different heights of exposed lower portions of selected tab portions of said base layer therebeneath.

9. The shingle of claim 8, tab portion of said underlying secondary wherein each said top shingle layer strip is comprised of at least one shingle strip corresponding in height to substantially the aggregate height of the butt portion and tab portion of said underlying secondary shingle layer.

10. The shingle of claim 9, wherein a plurality of substantially horizontally disposed adhesive strips throughout overlapping surfaces of the butt portions and tab portions of base and secondary shingle layers provide means connecting said base and secondary layers together, wherein a plurality of substantially vertically disposed adhesive strips throughout overlapping surface portions of said secondary and top shingle layers provide means connecting said secondary and top shingle layers together; including a substantially horizontal strip of release tape on the bottom surface of the base layer, near the upper end of the butt portion thereof; wherein at least one zone of a different aesthetic combination of granule arrangement is provided in tab portions of the secondary shingle layer, relative to butt portions of the secondary shingle layer; wherein the overall width of the shingle measured horizontally is approximately twice that of the height of the shingle measured vertically, comprising means facilitating pallet stacking of shingles at two generally coplanar shingles per layer, with alternate layers of shingles disposed at substantially right angled orientation relative to an underlying layer of shingles; and wherein said secondary layer has a tab portion edge disposed widthwise in protruding relation relative to a subjacent tab portion edge of said base layer, comprising means facilitating lapping adjacent edges of tab portions of adjacent shingles when installed on a roof.

11. The shingle of claim 10, wherein a substantially horizontal shadow line zone of dark granule arrangement is provided on the upper surface of the secondary layer at about the junction of the tab portion and butt portion, wherein said base layer and said secondary layer have butt portions forming at least one coterminus shingle edge.

12. The shingle of claim 1, wherein a plurality of substantially horizontally disposed adhesive strips throughout overlapping surfaces of the butt portions and tab portions of base and secondary shingle layers provide means connecting said base and secondary layers together.

13. The shingle of claim 1, wherein a plurality of substantially vertically disposed adhesive strips throughout overlapping surface portions of said secondary and top shingle layers provide means connecting said secondary and top shingle layers together.

14. The shingle of claim 1, wherein a plurality of substantially horizontally disposed adhesive strips throughout overlapping surfaces of the butt portions and tab portions of base and secondary shingle layers provide means connecting said base and secondary layers together, wherein a plurality of substantially vertically disposed adhesive strips throughout overlapping surface portions of said secondary and top shingle layers provide means connecting said secondary and top shingle layers together.

15. The shingle of claim 1, wherein a substantially horizontal line of sealant is disposed on the bottom surface of the base layer, near the lower edge thereof.

16. The shingle of claim 15, including a substantially horizontal strip of release tape on the bottom surface of the base layer, near the upper edge thereof.

17. The shingle of claim 1, including a substantially horizontal strip of release tape on the bottom surface of the base layer, near the upper edge thereof.

18. The shingle of claim 1, wherein at least one zone of a different aesthetic combination of granule arrangement is provided in tab portions of the base shingle layer, relative to butt portions of the base shingle layer.

19. The shingle of claim 18, wherein at least one zone of a different aesthetic combination of granule arrangement is provided in tab portions of the secondary shingle layer, relative to butt portions of the base shingle layer.

20. The shingle of claim 1, wherein at least one zone of a different aesthetic combination of granule arrangement is provided in tab portions of the secondary shingle layer, relative to butt portions of the secondary shingle layer.

21. The shingle of claim 1, wherein a substantially horizontal shadow line zone of dark granule arrangement is provided on the upper surface of the secondary layer at about the junction of the tab portion and butt portion.

22. The shingle of claim 1, wherein the overall width of the shingle measured horizontally is approximately twice that of the height of the shingle measured vertically, comprising means facilitating pallet stacking of shingles at two generally coplanar shingles per layer, with alternate layers of shingles disposed at substantially right angled orientation relative to an underlying layer of shingles.

23. The shingle of claim 1, wherein said base layer and said secondary layer have butt portions forming at least one coterminus shingle edge.

24. The shingle of claim 1, wherein said secondary layer has a tab portion edge disposed widthwise in protruding relation relative to a subjacent tab portion edge of said base layer, comprising means facilitating lapping adjacent edges of tab portions of adjacent shingles when installed on a roof.

* * * * *